US008378912B2

(12) United States Patent
Nishino et al.

(10) Patent No.: US 8,378,912 B2
(45) Date of Patent: Feb. 19, 2013

(54) ANTENNA COIL

(75) Inventors: Tatsumi Nishino, Tokyo (JP); Fumihito Meguro, Tokyo (JP); Takehiro Nakano, Tokyo (JP)

(73) Assignee: Sumida Corporation (JP)

( * ) Notice: Subject to any disclaimer, the term of this patent is extended or adjusted under 35 U.S.C. 154(b) by 714 days.

(21) Appl. No.: 12/296,293

(22) PCT Filed: Mar. 7, 2007

(86) PCT No.: PCT/JP2007/054404

§ 371 (c)(1),
(2), (4) Date: Oct. 7, 2008

(87) PCT Pub. No.: WO2007/116623

PCT Pub. Date: Oct. 18, 2007

(65) Prior Publication Data

US 2009/0115682 A1 May 7, 2009

(30) Foreign Application Priority Data

Apr. 7, 2006 (JP) ..... 2006-106347

(51) Int. Cl.
*H01Q 7/08* (2006.01)

(52) U.S. Cl. ..... 343/788; 343/867

(58) Field of Classification Search ..... 343/700 MS, 343/867, 742, 788

See application file for complete search history.

(56) References Cited

U.S. PATENT DOCUMENTS

| | | | | |
|---|---|---|---|---|
| 7,068,223 | B2 * | 6/2006 | Yoshida et al. | 343/700 MS |
| 2004/0061660 | A1 * | 4/2004 | Yoshida et al. | 343/788 |
| 2007/0195001 | A1 * | 8/2007 | Ueda | 343/788 |

FOREIGN PATENT DOCUMENTS

| | | | |
|---|---|---|---|
| EP | 1489683 | A1 | 12/2004 |
| JP | 2004-88139 | | 3/2004 |
| JP | 2006-66470 | | 3/2006 |
| JP | 2006-81140 | | 3/2006 |
| WO | 2005/062316 | A2 | 7/2005 |
| WO | 2005/088767 | | 9/2005 |

OTHER PUBLICATIONS

International Search Report for International Patent Application No. PCT/JP2007/054404 mailed May 22, 2007 with English Translation.

* cited by examiner

*Primary Examiner* — Robert Karacsony
(74) *Attorney, Agent, or Firm* — Cantor Colburn LLP

(57) ABSTRACT

An antenna coil may include a first coil portion wound with coil wire; a second coil portion wound with coil wire and intersecting with the first coil portion; and a case having a coil receiving portion receiving the first coil portion and the second coil portion, in which the first coil portion and the second coil portion are disposed so that extending directions of the respective coil portions are directed in diagonals direction of the coil receiving portion.

12 Claims, 8 Drawing Sheets

[Figure 1]
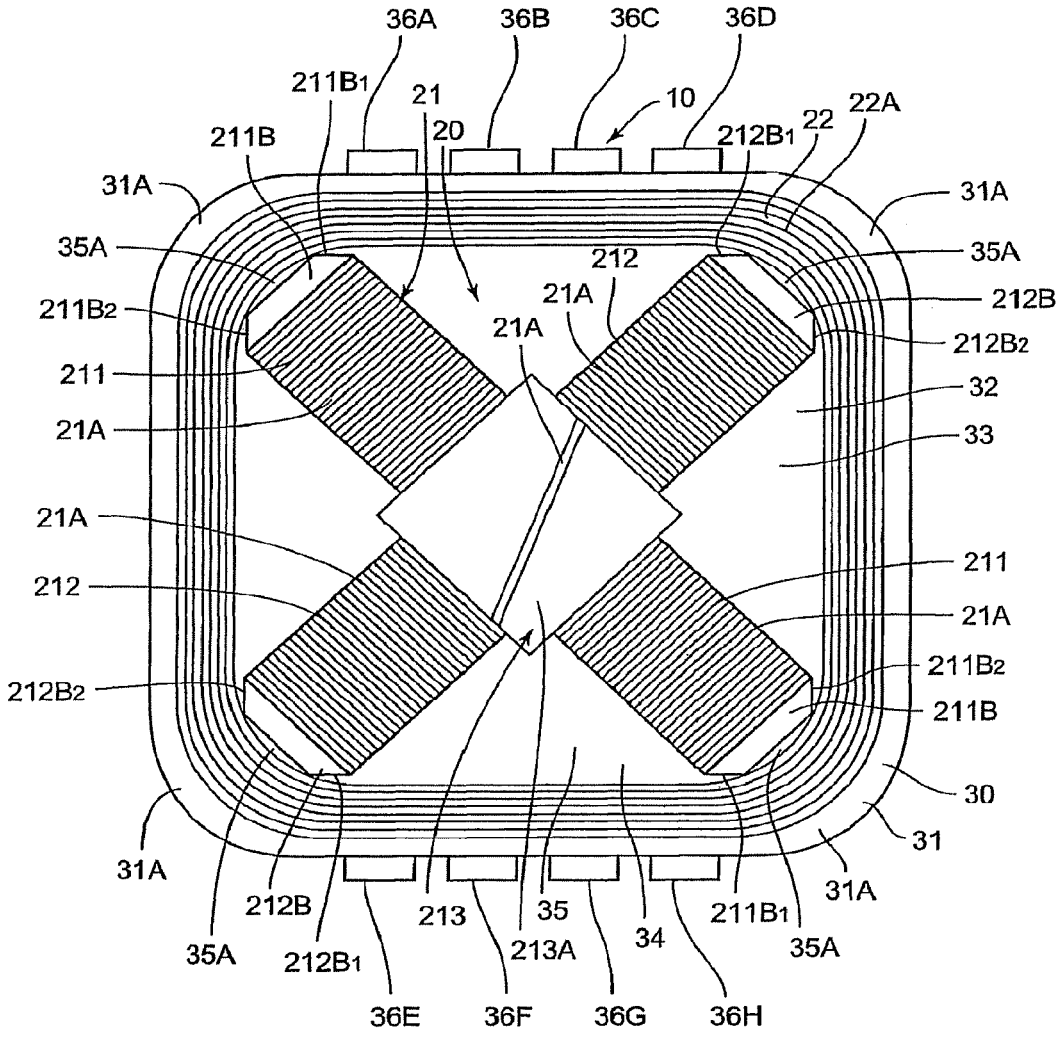

[Figure 2]
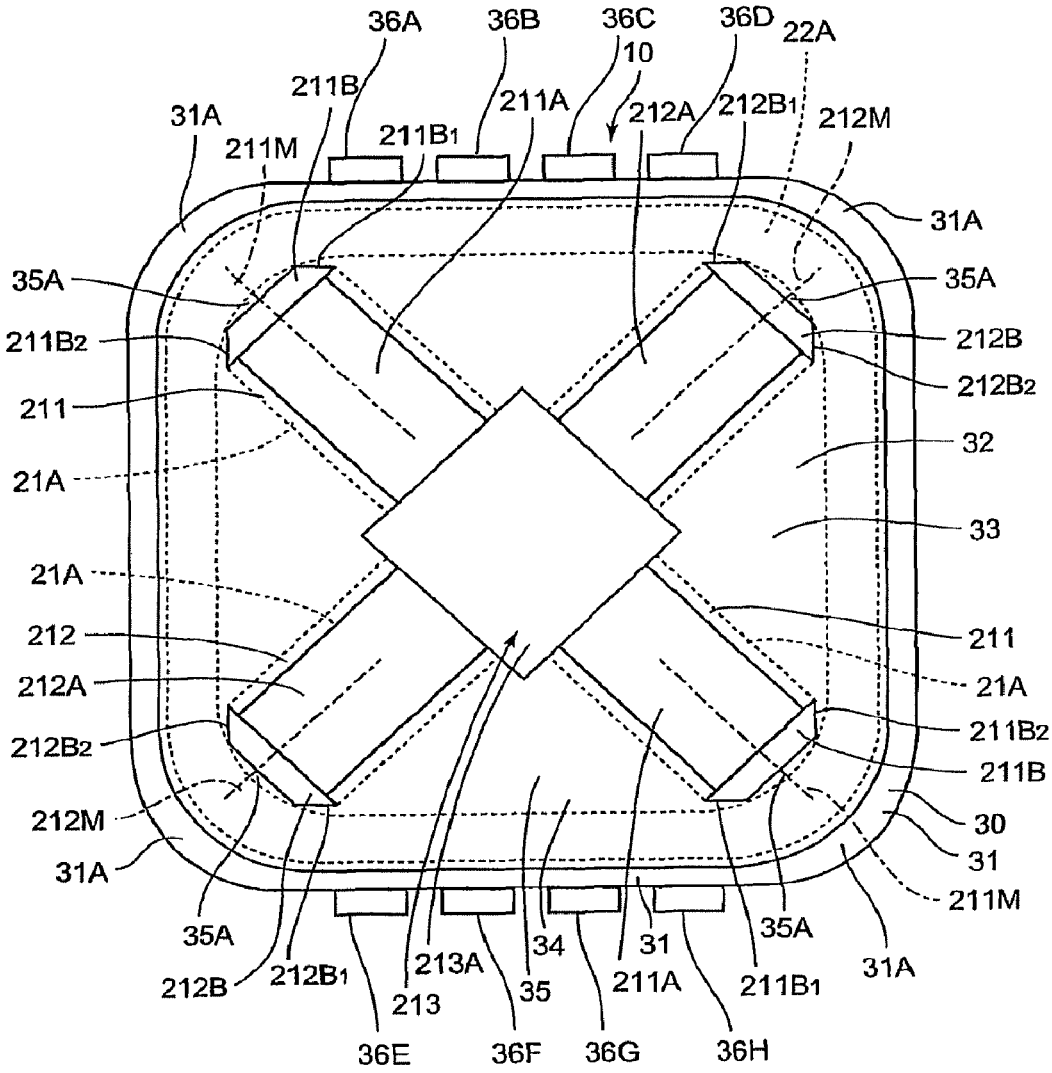

[Figure 3]
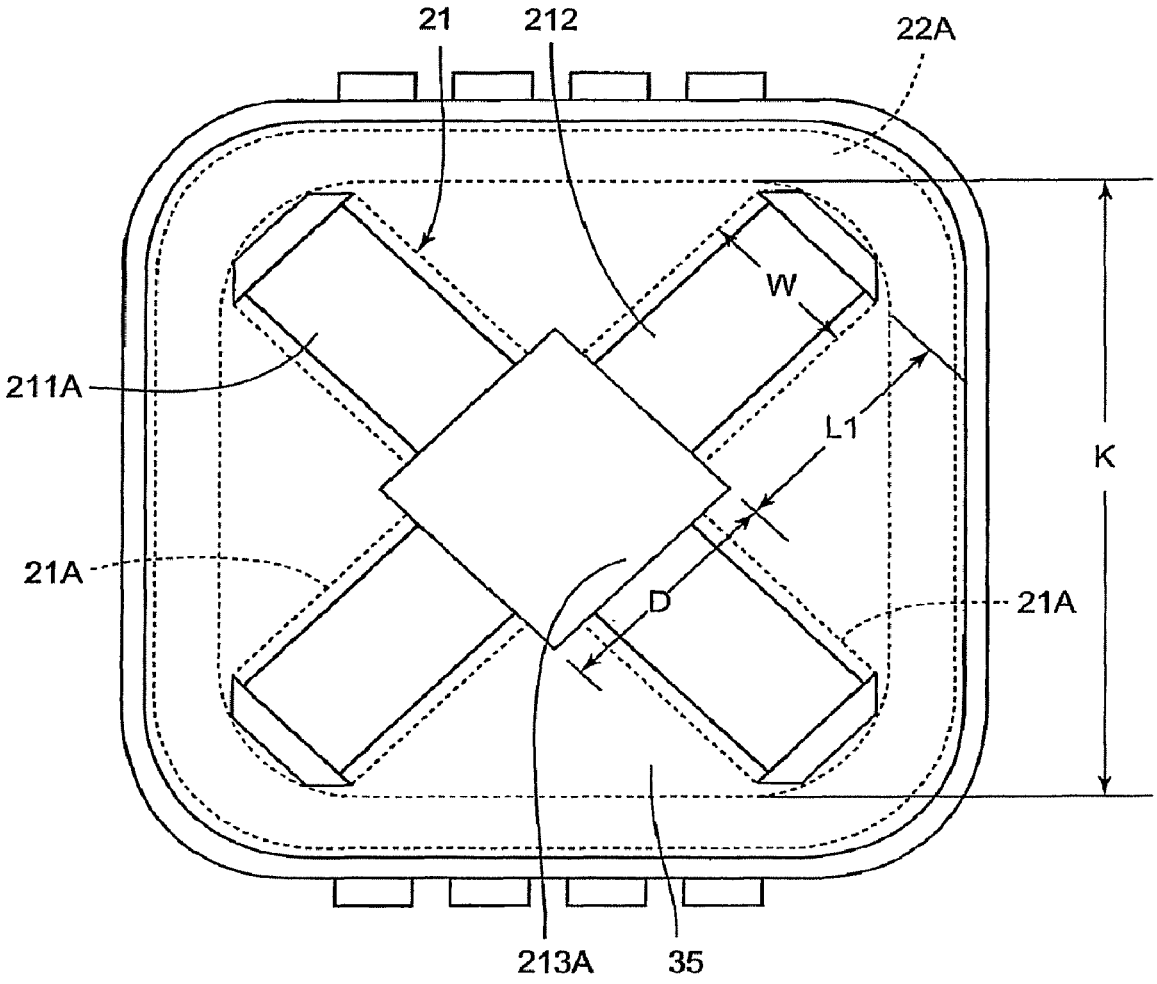

[Figure 4]
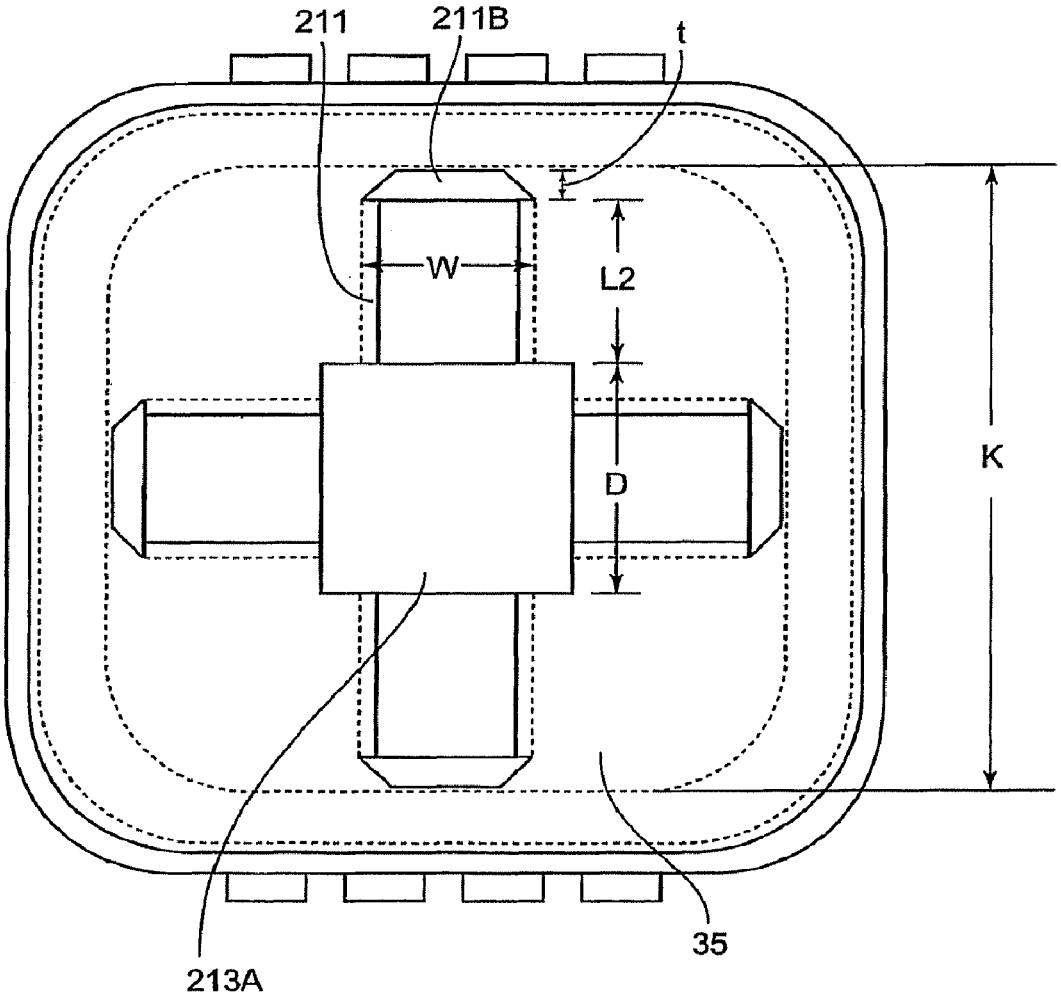

[Figure 5]
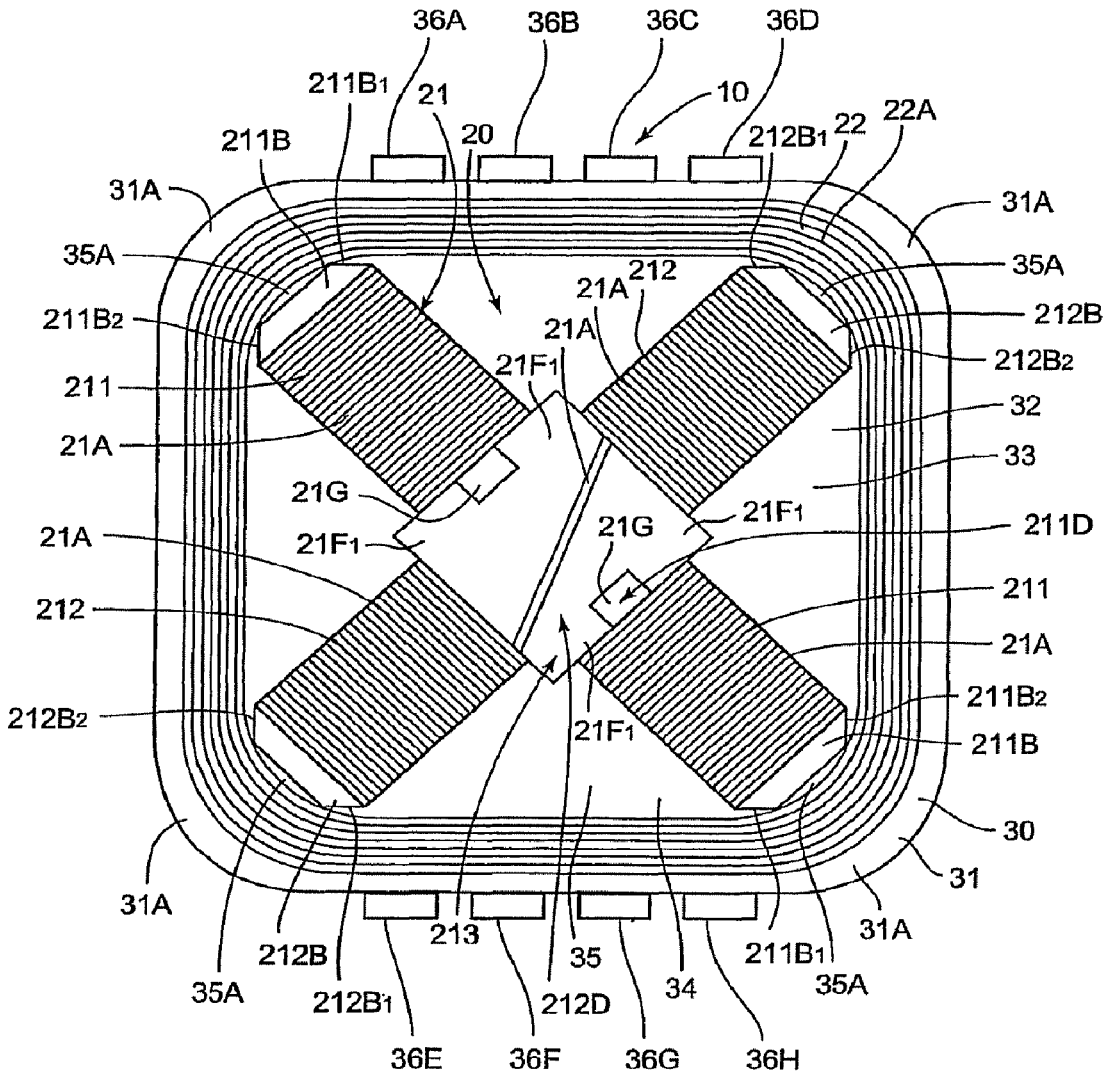

[Figure 6]
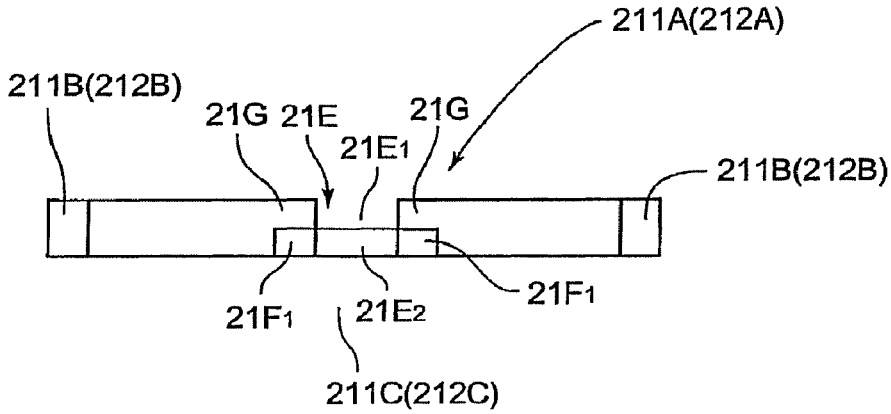
[Figure 7]
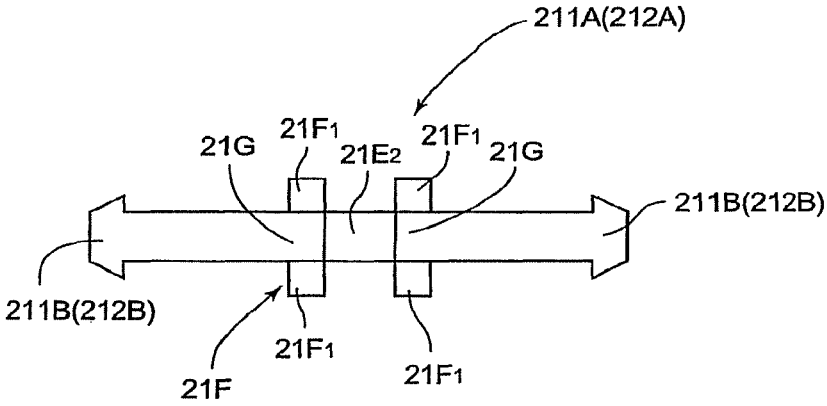

[Figure 8]
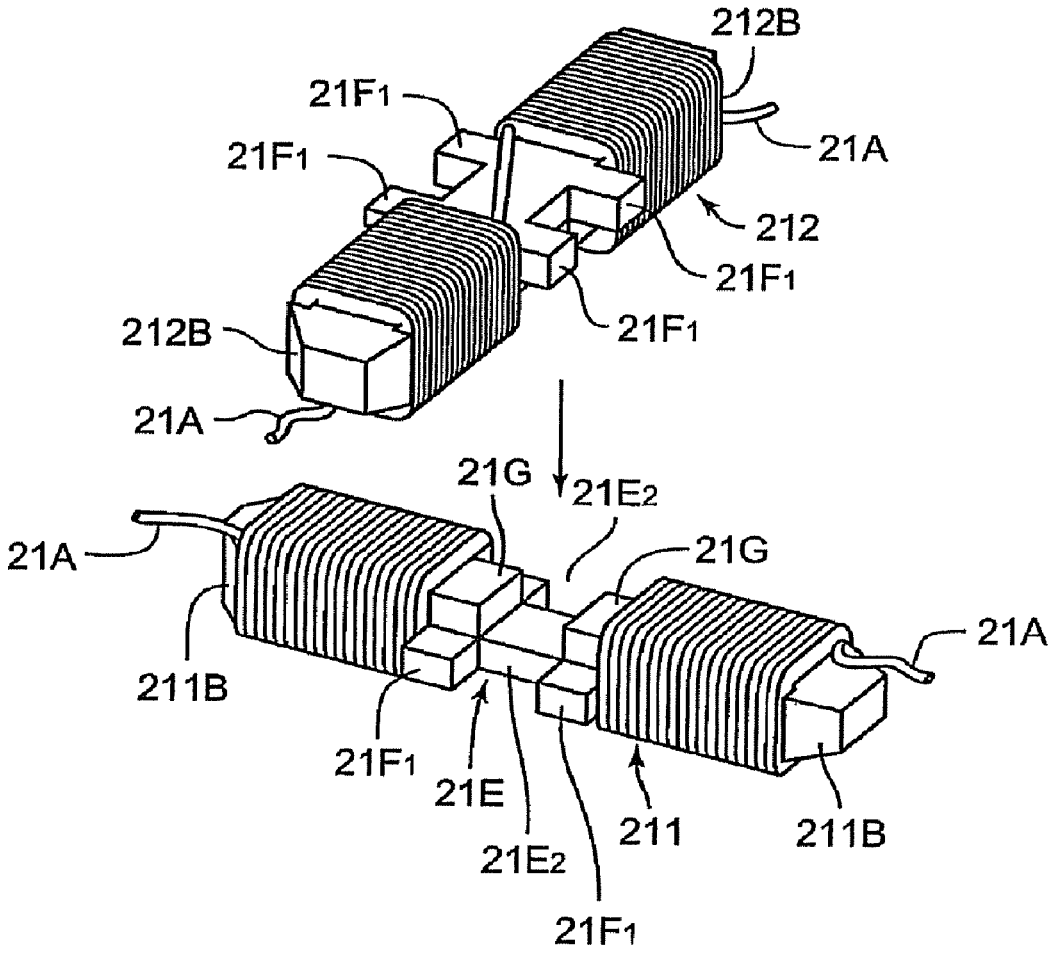

[Figure 9]
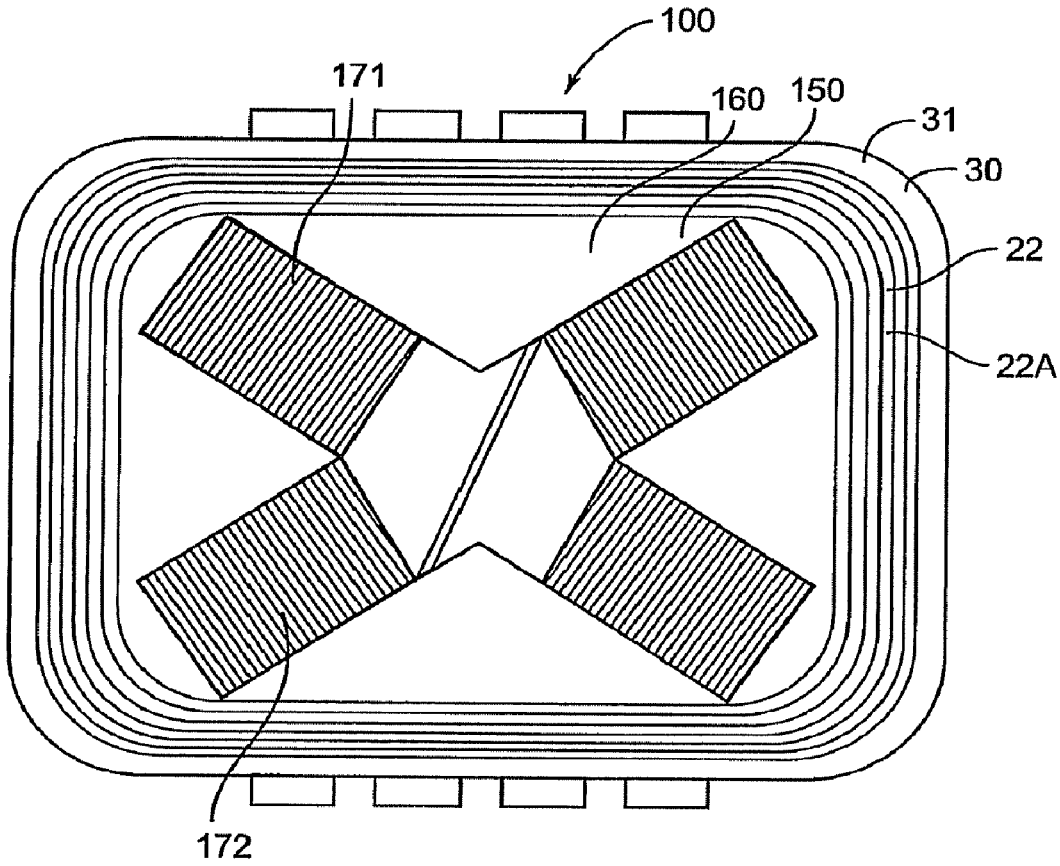

ANTENNA COIL

CROSS REFERENCE TO RELATED APPLICATIONS

This is a U.S. national stage of application No. PCT/JP2007/054404, filed on 7 Mar. 2007. Priority under 35 U.S.C. §119(a) and 35 U.S.C. §365(b) is claimed from Japanese Application No. 2006-106347, filed 7 Apr. 2006, the disclosure of which is also incorporated herein by reference.

TECHNICAL FIELD

The present invention relates to an antenna coil used for, for example, a remote keyless entry system for vehicles.

BACKGROUND ART

To perform various operations such as vehicle door unlocking and locking, a remote keyless entry system or a smart entry system has been applied widely. In such a remote keyless entry system, a user transmits electric waves having predetermined code information from a transmitter held by the user toward a receiver attached to a vehicle. The receiver receives the electric waves and a controller mounted on the vehicle performs vehicle door unlocking and locking operations when previously stored code information meets the predetermined code information.

Some of the receivers of this type have an antenna coil capable of receiving electric waves in three axial directions. As a conventional art relating to antenna coils capable of receiving such electric waves in three axial directions, there is, for example, a structure disclosed in Patent Document 1.

Patent Document 1 discloses that a coil structured in a cross shape is received in a case having a coil receiving portion of a square shape. The structure disclosed herein is made so that the extending directions of respective coil portions intersecting in a cross shape are positioned in parallel to respective sides of the coil receiving portion.

Patent Document 1: WO2005/088767 (refer to FIGS. 1, 5, and 6 and others)

DISCLOSURE OF THE INVENTION

Problem to be Solved by the Invention

As a method for increasing the sensitivity of an antenna coil, core volume may be increased by increasing a core length, or the number of turns of wound coil or coil length may be increased. On the other hand, increasing a core length, the number of turns of wound coil or coil length will enlarge the antenna coil.

In view of the foregoing circumstances, it is an object of the present invention to provide an antenna coil capable of attaining high sensitivity by increasing a core length, the number of turns of wound coil or a coil length without increasing the antenna coil size.

Means for Solving Problem

According to the present invention, an antenna coil includes: a first coil portion wound with coil wire; a second coil portion wound with coil wire and intersecting with the first coil portion; and a case having a coil receiving portion receiving the first coil portion and the second coil portion, in which the first coil portion and the second coil portion are disposed so that extending directions of the respective coil portions are directed in diagonal directions of the coil receiving portion.

Such a structure can increase the number of turns of wound coil or coil length in the first coil portion and the second coil portion. In a case where the first coil portion and the second coil portion have a core, respectively, the length of the core can be increased, thus increasing a core volume.

According to another invention, in addition to the above invention, an antenna coil is further structured so that at least one of a first core portion constituting a first coil portion and a second core portion constituting a second coil portion is inclined toward the central side of the core portion as a side face of a front end thereof comes closer to the front end.

With such a structure, lengths of the first core portion and the second core portion can be lengthened and therefore a core volume can be increased further.

According to still another invention, a first core portion and a second core portion are structured as separate members from each other and the first core portion and the second core portion are structured so as to have fitting portions fitted to each other at an intersecting portion of the first coil portion and the second coil portion.

With such a structure, the number of turns of wound coil in the first coil portion and the second coil portion or the coil length thereof can be increased.

According to still another invention, a first coil portion and a second coil portion are disposed so as to be orthogonal to each other.

With such a structure, there can be structured an antenna having sensitivity equivalent to each other in the extending directions of the first coil portion and the second coil portion.

According to still another invention, there is provided a third coil portion which is wound with coil wire in a direction orthogonal to extending directions of a first coil portion and a second coil portion and inside which the first coil portion and the second coil portion are disposed.

With such a structure, there can be structured an antenna also having high sensitivity in a direction orthogonal to extending directions of the first coil portion and the second coil portion.

According to still another invention, the whole of the antenna coil is resin molded except a coil terminal portion.

With such a structure, the antenna coil can be protected from an external impact.

Effect of the Invention

The present invention provides an antenna coil capable of attaining high sensitivity by increasing the length of a core, the number of turns of wound coil, or the coil length.

BRIEF DESCRIPTION OF THE DRAWINGS

FIG. 1 is a plan view illustrating a structure of an antenna coil according to one embodiment of the present invention.

FIG. 2 is a plan view of an antenna coil with a coil wire of the antenna coil in FIG. 1 shown by dotted lines.

FIG. 3 is a view for describing a coil length of the cross-shaped coil illustrated in FIG. 1.

FIG. 4 is a view for describing a coil length of a cross-shaped coil when the extending direction of the coil is extended along a peripheral wall portion.

FIG. 5 is a plan view illustrating a structure of another embodiment of the present invention.

FIG. 6 is a side view illustrating a structure of the first core portion or the second core portion shown in FIG. 5.

FIG. 7 is a plan view illustrating a structure of the first core portion or the second core portion shown in FIG. 5.

FIG. 8 is an exploded perspective view illustrating a structure of the cross-shaped coil shown in FIG. 5.

FIG. 9 is a view illustrating a modified example of an embodiment of the present invention.

DESCRIPTION OF REFERENCE NUMERALS

10 antenna coil
211 first coil portion
212 second coil portion
34 coil receiving portion
30 case
211A first core portion
212A second core portion
211B flange portion
212B flange portion
211$B_1$, 211$B_2$ side face
212$B_1$, 212$B_2$ side face
211D, 212D fitting portion

BEST MODE FOR CARRYING OUT THE INVENTION

Referring now to FIGS. 1 to 4, description will be made on an antenna coil 10 according to one embodiment of the present invention.

As illustrated in FIG. 1, the antenna coil 10 has a coil portion 20 and a case 30. The coil portion 20 has a cross-shaped coil 21 formed by winding coil wire 21A and a circling coil 22 formed by winding coil wire 22A.

The cross-shaped coil 21 has a first coil portion 211 and a second coil portion 212. The first coil portion 211 and the second coil portion 212 intersect with each other at a central portion thereof.

In this embodiment, a so-called three-axis coil includes the first coil portion 211, the second coil portion 212 and the circling coil 22. Specifically, the first coil portion 211 constitutes a coil in the X-axis direction and the second coil portion 212 constitutes a coil in the Y-axis direction. In other words, the first coil portion 211 and the second coil portion 212 are disposed so as to be orthogonal to each other. The circling coil 22 constitutes a coil in the Z-axis direction. Accordingly, the first coil portion 211 and the second coil portion 212 have high sensitivity in X-axis and Y-axis directions orthogonal to each other, respectively, and the circling coil 22 has high sensitivity in the Z-axis direction orthogonal to X-axis and Y-axis directions. The first coil portion 211 and the second coil portion 212 are orthogonal to each other and therefore sensitivity with uniform directivity can be ensured in the X-axis and Y-axis directions.

In the following description, a face along the extending directions of the first coil portion 211 and the second coil portion 212, that is, the longitudinal direction of a coil length is taken as a horizontal plane and a direction orthogonal to the horizontal plane as a vertical direction. Specifically, in FIG. 1, a direction along the paper face is the horizontal plane, and the front side of the paper face is top (upper side) and the rear side is bottom (lower side).

The circling coil 22 is disposed so as to surround the cross-shaped coil 21 in the direction along the horizontal plane. Specifically, the circling coil 22 is wound so that the coil wire 22A is wound up in a direction orthogonal to the extending directions of the first coil portion 211 and the second coil portion 212. Accordingly, the first coil portion 211 and the second coil portion 212 are disposed inside the circling coil 22. The case 30 is in a box shape having a peripheral wall portion 31 provided upright to the horizontal plane and a bottom portion 32 disposed along the horizontal plane, and is in a rectangular-parallelepiped shape flattened vertically as a whole. Above the bottom portion 32, there is provided an opening 33.

The peripheral wall portion 31 is arranged so as to surround the bottom portion 32, and the inside of the peripheral wall portion 31 is a coil receiving portion 34, four sides of which are surrounded by the peripheral wall portion 31. In the present embodiment, the coil receiving portion 34 surrounded by the peripheral wall portion 31 is a square space as the whole shape in top view. The peripheral wall portion 31 forming the coil receiving portion 34 has a rounded corner portion 31A at a corner portion of the square, but the coil receiving portion 34 has a square space in the whole view. The cross-shaped coil 21 and the circling coil 22 are received in the coil receiving portion 34.

The circling coil 22 is formed by winding coil wire 22A several times over vertically and horizontally along an inside surface of the peripheral wall portion 31. One end of the coil wire 22A of the circling coil 22 is connected to a connection terminal 36A and the other end thereof is connected to a connection terminal 36E, respectively.

Inside the circling coil 22, there is formed a cross-shaped coil receiving portion 35 where the cross-shaped coil 21 is disposed. The cross-shaped coil receiving portion 35 is a space formed by an inner-peripheral surface of the circling coil 22 received in the coil receiving portion 34 and is formed as a square space wholly in top view in the same way as for the coil receiving portion 34. In the present embodiment, the coil wire 22A is wound along the rounded corner portion 31A and therefore the four corner portions 35A of the cross-shaped coil receiving portion 35 have a round-shape, respectively, but the circling coil 22 has a square space in the whole view.

The cross-shaped coil 21 is disposed so that the longitudinal directions, that is, the extending directions of the first coil portion 211 and the second coil portion 212 are aligned with the diagonal directions of the cross-shaped coil receiving portion 35 of a square shape. Specifically, the cross-shaped coil 21 is disposed so that the front ends of the first coil portion 211 and the second coil portion 212 face the four corner portions 35A. The corner portion 35A is positioned inside the corner portion 31A of the peripheral wall portion 31 and therefore the first coil portion 211 and the second coil portion 212 of the cross-shaped coil 21 are disposed so that the longitudinal directions, that is, the extending directions are along the diagonal directions of the coil receiving portion 34.

Of the cross-shaped coil 21, one end of wire 21A of the first coil portion 211 is connected to a connection terminal 36B and the other end thereof is connected to a connection terminal 36F, respectively. One end of wire 21A of the second coil portion 212 is connected to a connection terminal 36C and the other end thereof is connected to a connection terminal 36G, respectively. Connection terminals 36D and 36H are dummy connection terminals. The antenna coil 10 is connected to an external circuit board (not illustrated) or the like through the connection terminals 36A, 36B, 36C, 36E, 36F, and 36G.

The cross-shaped coil 21, as illustrated in FIG. 2, has a cross-shaped core portion 213 constituting the first core portion 211A and the second core portion 212A. For easy understanding of the structure of the antenna coil 10, the coil wire 21A forming the cross-shaped coil 21 and the coil wire 22A forming the circling coil 22 are not illustrated but shown by dotted lines in FIG. 2.

The first core portion 211A constitutes a core portion of the first coil portion 211 and the second core portion 212A constitutes a core portion of the second coil portion 212. At both ends of the first core portion 211A in the longitudinal direction, there are provided flange portions 211B serving as front ends of the first core portion 211A. At both ends of the second core portion 212A in the longitudinal direction, there are provided flange portions 212B serving as front ends of the second core portion 212A. The cross-shaped core portion 213 has a plate-shaped body flattened vertically, and the widths of the flange portions 211B and 212B in the horizontal plane direction are a little larger than those of the first core portion 211A and the second core portion 212A in the horizontal direction. The intersecting portion 213A where the first core portion 211A and the second core portion 212A intersect with each other is formed to be a little wider than the widths in the horizontal direction of the first core portion 211A and the second core portion 212A.

Each side of the first core portion 211A positioned on both sides of the intersecting portion 213A sandwiched therebetween is wound with the coil wire 21A. The coil wire 21A is wound along the direction intersecting with the longitudinal direction of the first core portion 211A, thereby the first coil portion 211 is formed. Further, in the second core portion 212A, each side of the second core portion 212A positioned on both sides of the intersecting portion 213A sandwiched therebetween is wound with the coil wire 21A. The coil wire 21A is wound along the direction intersecting with the longitudinal direction of the second core portion 212A, thereby the second coil portion 212 is formed.

The flange portion 211B and the intersecting portion 213A are formed so as to be a little wider in the horizontal plane direction than the first core portion 211A existing therebetween. Accordingly, a winding position of the coil wire 21A wound around the first core portion 211A is defined by the flange portion 211B in the front-end direction and, on the central side, a winding position is defined by the intersecting portion 213A. Specifically, a winding position of the coil wire 21A is regulated by the flange portion 211B so that the coil wire is not pulled out in the front-end direction and is regulated by the intersecting portion 213A so that the coil wire is not shifted in the central direction. Further, a winding position of the coil wire 21A wound around the second core portion 212A is defined by the flange portion 212B in the front-end direction and defined by the intersecting portion 213A on the central side. Specifically, a winding position of the coil wire 21A is regulated by the flange portion 212B so that the coil wire is not pulled out in the front-end direction and is regulated by the intersecting portion 213A so that the coil wire is not shifted in the central direction.

The flange portion 211B is structured so that, as side faces 211$B_1$, 211$B_2$ positioned on both sides of the first core portion 211A in the horizontal plane direction come closer to the front end side, the distance between the side faces become narrower. Specifically, as the side faces go further in the front-end direction, the side faces incline toward the inside which is in the central direction of the first core portion 211A. The flange portion 212B is structured so that, as side faces 212$B_1$, 212$B_2$ come closer to the front end side, the distance between the side faces become narrower, in the same way as the flange portion 211B. Specifically, as the side faces go further in the front-end direction, the side faces incline toward the inside which is in the central direction of the second core portion 212A.

In the present embodiment, the side faces 211$B_1$, 211$B_2$ of the flange portion 211B have an inclination of 45 degrees to the center line 211M (refer to FIG. 2). Similarly, the side faces 212$B_1$, 212$B_2$ of the flange portion 212B have an inclination of 45 degrees to the center line 212M. Accordingly, when the cross-shaped coil 21 is received in the cross-shaped coil receiving portion 35 provided inside the circling coil 22, the side faces 211$B_1$, 211$B_2$ and the side faces 212$B_1$, 212$B_2$ are arranged in the direction along an inner side face of the circling coil 22.

As described above, by receiving the cross-shaped coil 21 in the cross-shaped coil receiving portion 35 so that the first coil portion 211 and the second coil portion 212 are directed in diagonal directions of the coil receiving portion 34, the lengths of the first core portion 211A and the second core portion 212A can be increased more than when the cross-shaped coil is disposed in such a direction that the extending directions of the first coil portion 211 and the second coil portion 212 follow the peripheral wall portion 31. Thus, the core volume can be increased and the sensitivity of the antenna coil 10 can be enhanced. In addition, by inwardly inclining the side faces 211$B_1$, 211$B_2$ of the flange portion 211B and the side faces 212$B_1$, 212$B_2$ of the flange portion 212B, the flange portion 211B serving as the front end of the first core portion 211A and the flange portion 212B serving as the front end of the second core portion 212A can be further extended to the corner portion 35A side. Specifically, the first core portion 211A and the second core portion 212A can be further lengthened and the core volume can be increased, thus enhancing the sensitivity of the antenna coil 10. In addition, by making the shape of each front end of the flange portion 211B and the flange portion 212B into a shape following an internal shape of the corner portion 35A, the lengths of the first core portion 211A and the second core portion 212A can be increased to a maximum within the cross-shaped coil receiving portion 35. Further, since the coil lengths of the first coil portion 211 and the second coil portion 212 can be increased as compared to a layout in such a direction that the extending directions of the first coil portion 211 and the second coil portion 212 follow the peripheral wall portion 31, the sensitivity of the antenna coil 10 can be enhanced.

Further, by inwardly inclining the side faces 211$B_1$, 211$B_2$ of the flange portion 211B and the side faces 212$B_1$, 212$B_2$ of the flange portion 212B, the first coil portion 211 and the second coil portion 212 can be brought into close contact with an inner side face of the circling coil 22. Accordingly, coil lengths of the first coil portion 211 and the second coil portion 212 can be increased, thus increasing the number of turns of wound coil.

The front ends of the first core portion 211A and the second core portion 212A may be structured so that side faces of the front ends of the first core portion 211A and the second core portion 212A are inclined inward without forming the flange portions 211B and 212B. In this case as well, the front ends of the first core portion 211A and the second core portion 212A are further extended to the corner portion 35A side and therefore the first core portion 211A and the second core portion 212A can be further lengthened.

Where the antenna coil 10 is structured like the present embodiment, by appropriately setting the width of a portion around which coil wire 21A is wound, a coil length can be increased. Referring to FIGS. 3 and 4, this will be described below. The coil wires 21A, 22B are no illustrated but shown by dotted lines in FIGS. 3 and 4, in the same way as FIG. 2.

FIG. 3 illustrates a state where the antenna coil 10 is arranged so that the extending directions of the first coil portion 211 and the second coil portion 212 follow the diagonal directions of the cross-shaped coil receiving portion 35. On the other hand, FIG. 4 illustrates a state where the antenna coil 10 is arranged so that the extending directions of the first coil portion 211 and the second coil portion 212 follow side portions of the cross-shaped coil receiving portion 35.

In FIG. 3, the length of the intersecting portion 213A of the second coil portion 212 (a length of the second coil portion 212 in the extending direction) is taken as "D" and the width of a portion around which the coil wire 21A is wound is taken as "W". In addition, the width of the cross-shaped coil receiving portion 35 receiving the cross-shaped coil 21 (the first coil portion 211 and the second coil portion 212) is taken as "K". In this case, the coil length L1 of the first coil portion 211 (second coil portion 212) can be a length expressed by the following Equation (1):

$$L1=(K/2)\cdot 2^{1/2}-(D/2+W/2) \quad (1)$$

On the other hand, in FIG. 4, the length of the intersecting portion 213A of the first coil portion 211 (the length of the first coil portion 211 in the extending direction) is taken as "D", the width of a portion around which a coil wire is wound is taken as "W" and the length of the flange portion 211B (the length of the first coil portion 211 in the extending direction) is taken as "t". Further, the width of the cross-shaped coil receiving portion 35 receiving the first coil portion 211 and the second coil portion 212 is taken as "K". In this case, the coil length L2 of the first coil portion 211 can be a length expressed by the following Equation (2):

$$L2=(K/2)-(D/2+t) \quad (2)$$

The length difference between L1 and L2 is expressed by the following Equation (3):

$$L1-L2=K/2\cdot(2^{1/2}-1)-W/2+t \quad (3)$$

Accordingly, when W is within the range of the following Equation (4), receiving each of the first coil portion 211 and the second coil portion 212 in the diagonal directions of the coil receiving portion 34 can ensure a longer coil lengths of the first coil portion 211 and the second coil portion 212 than when the cross-shaped coil 21 is disposed by making the first coil portion 211 and the second coil portion 212 follow the side portions of the cross-shaped coil receiving portion 35.

$$W<K\cdot(2^{1/2}-1)+2t \quad (4)$$

In the case as illustrated in FIG. 4, the flange portion 211B (flange portion 212B) has no effect onto the length of a coil length, even if the side faces 211$B_1$, 211$B_2$ (side faces 212$B_1$, 212$B_2$) are inclined.

With the structure illustrated in FIG. 4, the longest coil length can be ensured when no flange portion 211B (212B) is provided. With the structure illustrated in FIG. 4, because t=0 in the Equation (2) when no flange portion 211B (212B) is provided, the coil length L2 is as follows: L2=(K/2)−D/2.

When the cross-shaped coil 21 is arranged as illustrated in FIG. 3 and W is set to a range of $W<K\cdot(2^{1/2}-1)$, substituting t=0 in Equation (4), a larger coil length can be ensured while the flange portion 211B (flange portion 212B) is provided than when the cross-shaped coil 21 is arranged as illustrated in FIG. 4.

Referring next to FIGS. 5 to 8, description will be made on an antenna coil 11 according to other embodiments of the antenna coil 10 described in the foregoing embodiments. The same members as in the antenna coil 10 above will be assigned the same reference numerals/symbols and the description thereof will not be repeated.

In the present embodiment, a first core portion 211A and a second core portion 212A constituting a cross-shaped core portion 213 are separate members. A fitting portion 211D formed in the center of the first core portion 211A and a fitting portion 212D formed in the center of the second core portion 212A are fitted to each other to form the cross-shaped core portion 213.

FIG. 5 is a view illustrating a state where a cross-shaped coil 21 completed by fitting the first core portion 211A and the second core portion 212A at the fitting portion 211D and the fitting portion 212D is received in a cross-shaped coil receiving portion 35.

FIGS. 6 to 8 are views for describing structures of the fitting portion 211D and the fitting portion 212D. FIG. 6 is a side view illustrating a structure of the first core portion 211A (the second core portion 212A), and FIG. 7 is a plan view of the first core portion 211A (the second core portion 212A) when viewed from the above. FIG. 8 is an exploded perspective view of the cross-shaped coil 21. The first core portion 211A and the second core portion 212A have the same structure including the fitting portion 211D and the fitting portion 212D. Accordingly, FIGS. 6 and 7 illustrate both the structures of the first core portion 211A and the second core portion 212A.

The fitting portion 211D (212D) includes a vertical fitting portion 21E, a horizontal fitting portion 21F and a horizontal fitted portion 21G. The vertical fitting portion 21E is formed in a shape in which a central portion of the first core portion 211A (second core portion 212A) is cut into a recessed shape to a depth of half the thickness and is structured so that the cut portion is made to serve as a receiving portion 21$E_1$ and the remaining portion is made to serve as a received portion 21$E_2$. The respective vertical fitting portions 21E of the first core portion 211A and the second core portion 212A are cut into the same shape as each other, that is, halving joint portions are formed.

Accordingly, when the first core portion 211A and the second core portion 212A are intersected at right angles to each other and vertically overlapped with each other so that the receiving portions 21$E_1$ face each other at the vertical fitting portion 21E, the received portion 21$E_2$ of the vertical fitting portion 21E of one of the core portions is fitted into the receiving portion 21$E_1$ of the vertical fitting portion 21E of the other core portion and hence the first core portion 211A and the second core portion 212A are fitted to each other.

The horizontal fitting portion 21F has four protruding portions 21$F_1$ protruding from side faces on both sides of the first core portion 211A (the second core portion 212A). On each of the side faces, two protruding portions 21$F_1$ are formed along an extending direction of the first coil portion 211 (the second coil portion 212). The protruding portion 21$F_1$ is formed into half the thickness of the first core portion 211A (the second coil portion 212) on the side where the received portion 21$E_2$ is formed in the vertical direction of the first core portion 211A (the second core portion 212A).

The distance between the two protruding portions 21$F_1$ formed on each side face of the first core portion 211A (the second core portion 212A) is a distance that the horizontal fitted portion 21G is fitted without gap. Specifically, the horizontal fitting portion 21F is a fitting portion formed of the two protruding portions 21$F_1$ at the each side face. The two horizontal fitted portion 21G are formed with the vertical fitting portion 21E therebetween, along the extending direction of the first coil portion 211 (the second coil portion 212).

The first core portion 211A and the second core portion 212A having the horizontal fitting portion 21F and the horizontal fitted portion 21G are intersected at right angles to each other, and the horizontal fitting portion 21F and the horizontal fitted portion 21G are vertically overlapped with each other with the sides where the horizontal fitted portions 21G face each other. Accordingly, the horizontal fitted portion 21G on the side of the second core portion 212A is fitted into the horizontal fitting portion 21F on the side of the first core portion 211A, and the horizontal fitted portion 21G on the side of the first core portion 211A is fitted into the horizontal fitting portion 21F on the side of the second core portion 212A. Hence, the first core portion 211A and the second core portion 212A are fitted to each other.

The cross-shaped coil 21 is completed by fitting the first coil portion 211 and the second coil portion 212, which are prepared separately, at the fitting portion 211D and the fitting portion 212D. Specifically, the coil wire 21A is wound around the first core portion 211A to form the first coil portion 211. In addition, the coil wire 21A is wound around the second core portion 212A in a separate state from the first core portion 211A to form the second coil portion 212. The first coil portion 211 and the second coil portion 212 prepared separately in this way are completed as the cross-shaped coil 21 by fitting the fitting portions 211D and 212D to each other.

In winding the coil wire 21A around the first core portion 211A and the second core portion 212A with a winding machine by separately preparing the first coil portion 211 and the second coil portion 212, the winding machine can be brought near the first core portion 211A and the second core portion 212A. Accordingly, the coil wire 21A can be brought very close to, in particular, the fitting portion 211D on the central side. Thus, the coil length of the first coil portion 211 can be increased as well as the number of turns of wound coil. For the second coil portion 212 as well, the coil wire 21A can be brought very close to the fitting portion 212D on the central side and therefore the coil length of the second coil portion 212 can be increased as well as the number of turns of wound coil.

On the contrary, for example, in performing winding work around the first core portion 211A when winding work is performed in such a state that the first core portion 211A and the second core portion 212A are fitted to each other forming a cross shape, a winding machine is difficult to bring close to the first core portion 211A due to presence of the second core portion 212A. In performing winding work for the second core portion 212A, a winding machine is difficult to bring close to the second core portion 212A due to presence of the first core portion 211A. Accordingly, especially in performing winding work to the vicinity of the fitting portions 211D, 212D, the first core portion 211A or the second core portion 212A is a barrier to wiring work and the coil wire cannot be pulled sufficiently near the fitting portions 211D, 212D for wiring work.

Fitting the fitting portions 211D and 212D to each other may be performed after adhesive or the like is applied to both portions, thus reinforcing bonding between the fitting portion 211D and the fitting portion 212D.

FIG. 9 illustrates a structure of an antenna coil 100 as a modified example of the antenna coil 10 described in the foregoing embodiments. Components having the same functions and structures as those of the antenna coil 10 in the embodiments above will be assigned the same reference numerals/symbols, and the description thereof will not be repeated.

In the antenna coil 100, a coil receiving portion 150 and a cross-shaped coil receiving portion 160 have a rectangular shape, respectively, while the coil receiving portion 34 and the cross-shaped coil receiving portion 35 are of square shape in the above embodiments. The length of the antenna coil 100 in right/left direction in FIG. 9 is set to be larger than the length in the up/down direction. The extending directions of a first coil portion 171 and a second coil portion 172 constituting a cross-shaped coil 170 are set to be along diagonal directions of the cross-shaped coil receiving portion 160. With such a structure, the coil length can be set to be larger than the coil length when the cross-shaped coil 170 is disposed in a manner that the first coil portion 171 and the second coil portion 172 follow the side portions of the cross-shaped coil receiving portion 160.

Any antenna coil 10 (antenna coil 100) of the respective embodiments and modified examples thereof has a three-axis coil structure, but may have two-axis coil structure in X-axis and Y-axis directions including the first coil portion 211 (171) and the second coil portion 212 (172) without the circling coil 22 constituting a coil in Z-axis direction.

The first coil portion 211 (171) and the second coil portion 212 (172) illustrated in the respective embodiments and modified examples above have the coil wire 21A wound on both sides in the longitudinal direction, but may have such a structure that the coil wire 21A is wound only on a half side in the longitudinal direction.

The whole of the antenna coil 10 (100) may be molded with resin. Such a structure can prevent the cross-shaped coil 21 (170) or the circling coil 22 from dropping off the case 30 and protect the antenna coil 10 (100) from an external impact or the like.

The first core portion 211A, the second core portion 212A, a core member constituting the first coil portion 171 and a core member constituting the second coil portion 172 may be formed of the same shape and same material on both sides of the central portions in the longitudinal directions or an asymmetrical shape having different length or width between one side and the other side, or may be formed of different materials on respective sides.

INDUSTRIAL APPLICABILITY

Coil components of the present invention are applicable in an electric apparatus field.

The invention claimed is:

1. An antenna coil comprising:

a first coil portion including a first core portion around which coil wire is wound;

a second coil portion including a second core portion wound with coil wire and intersecting with the first coil portion; and a case having a coil receiving portion receiving the first coil portion and the second coil portion as a cross-shaped coil, wherein the first coil portion and the second coil portion are structured as separate members from each other and have fitting portions fitting to each other at an intersection of the first coil portion and the second coil portion;

the fitting portion of the first coil portion includes four protruding portions extending from two opposite sides of the first coil portion at a distance apart so as to form a receiving portion configured to receive the fitting portion of the second coil portion therebetween;

the fitting portion of the second coil portion includes four protruding portions extending from two opposite sides of the second coil portion at a distance apart so as to form a receiving portion configured to receive the fitting portion of the first coil portion therebetween.

2. The antenna coil according to claim 1, wherein at least one of the first coil portion and the second coil portion comprises a flange portion provided at an end of the first core portion or the second core portion opposite to the fitting portion of the first coil portion or the second coil portion;

at the end of the at least one of the first core portion or the second core portion opposite to the fitting portion of the first coil portion or the second coil portion, a width of the flange portion is greater than a width of the at least one of the first core portion or the second core portion; and the width of the flange portion decreases in a direction away from the at least one of the first core portion or the second core portion.

3. The antenna coil according to claim 1, wherein the first coil portion and the second coil portion are disposed to be orthogonal to each other.

4. The antenna coil according to claim 1, further comprising a third coil portion around which coil wire is wound in a direction orthogonal to extending directions of the first coil portion and the second coil portion and inside which the first coil portion and the second coil portion are disposed.

5. The antenna coil according to claim 1, wherein the whole of the antenna coil is resin molded except a coil terminal portion.

6. The antenna coil according to claim 2, wherein the first core portion and the second core portion are structured as separate members from each other and have fitting portions fitted to each other at an intersecting portion of the first coil portion and the second coil portion.

7. The antenna coil according to claim 2, wherein the first coil portion and the second coil portion are disposed to be orthogonal to each other.

8. The antenna coil according to claim 2, further comprising a third coil portion around which coil wire is wound in a direction orthogonal to extending directions of the first coil portion and the second coil portion and inside which the first coil portion and the second coil portion are disposed.

9. The antenna coil according to claim 2, wherein the whole of the antenna coil is resin molded except a coil terminal portion.

10. The antenna coil according to claim 3, further comprising a third coil portion around which coil wire is wound in a direction orthogonal to extending directions of the first coil portion and the second coil portion and inside which the first coil portion and the second coil portion are disposed.

11. The antenna coil according to claim 3, wherein the whole of the antenna coil is resin molded except a coil terminal portion.

12. The antenna coil according to claim 4, wherein the whole of the antenna coil is resin molded except a coil terminal portion.

* * * * *